United States Patent [19]

Brieger

[11] 4,285,402

[45] Aug. 25, 1981

[54] METHOD AND APPARATUS FOR STIMULATING OIL WELL PRODUCTION

[76] Inventor: Emmet F. Brieger, Bonito Rt., Nogal, N. Mex. 88341

[21] Appl. No.: 144,688

[22] Filed: Apr. 28, 1980

[51] Int. Cl.[3] ..... E21B 33/129; E21B 34/10; E21B 37/00

[52] U.S. Cl. ..... 166/311; 166/120; 166/126; 166/133; 166/317

[58] Field of Search ..... 166/120, 123, 126, 133, 166/142, 149, 181, 185, 188, 196, 164, 311, 317

[56] References Cited

U.S. PATENT DOCUMENTS

| | | | |
|---|---|---|---|
| 2,290,141 | 7/1942 | Burt | 166/149 X |
| 2,675,879 | 4/1954 | Middleton et al. | 166/142 X |
| 2,778,430 | 1/1957 | Baker | 166/131 X |
| 3,032,111 | 5/1962 | Corley, Jr. et al. | 166/126 X |
| 3,032,116 | 5/1962 | Barry | 166/142 X |
| 3,412,797 | 11/1968 | Huitt et al. | 166/311 X |
| 3,831,680 | 8/1974 | Edwards et al. | 166/311 |

*Primary Examiner*—Stephen J. Novosad

[57] ABSTRACT

A system for cleaning perforations in a well bore where the perforations are located below a packer means on a production tubing. A tool on a string of pipe has packer means for sealing off the cross-section of the production tubing and the pressure in the annulus between the string of pipe and production tubing is reduced. The tool has a bypass passage across the packer means which opens upon the reaching of a predetermined pressure across the packer means and the high volume pressure from the earth formations suddenly flows through the tool and cleaning of the perforations is effected.

9 Claims, 6 Drawing Figures

FIG. 3
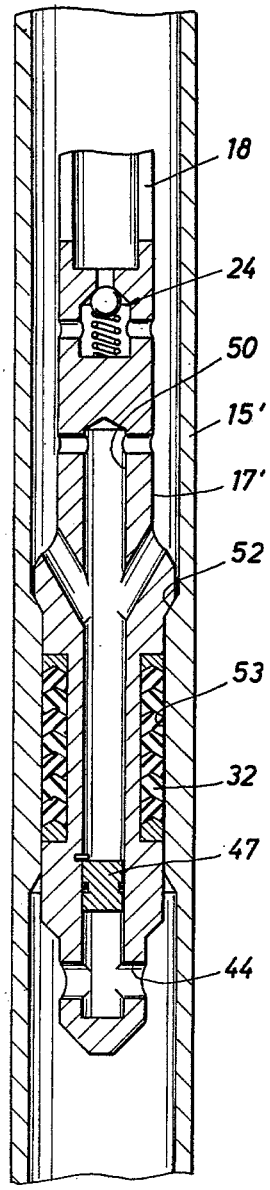
FIG. 4
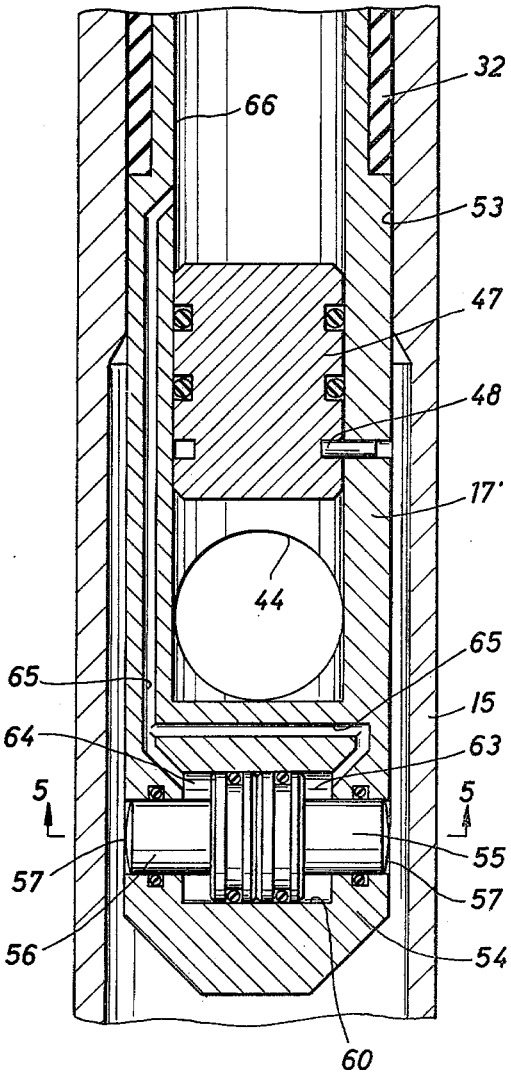
FIG. 6
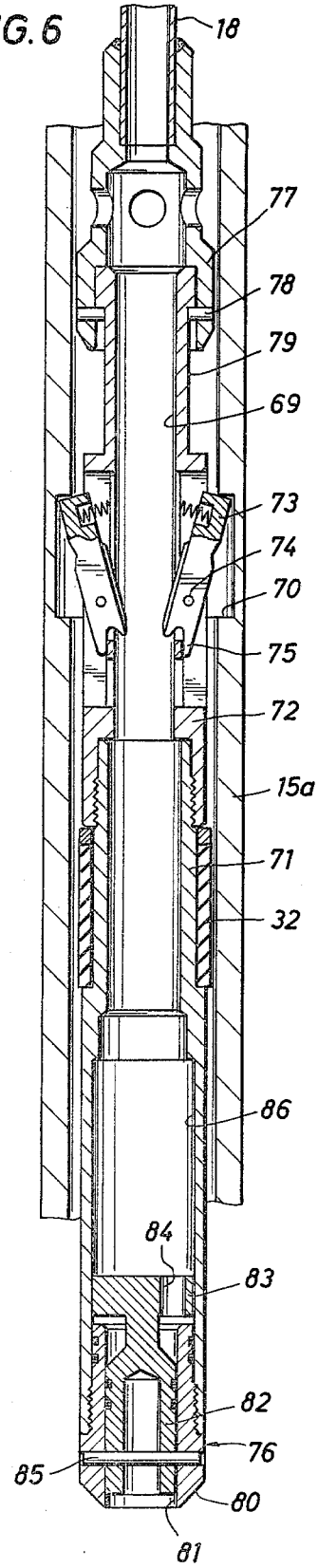
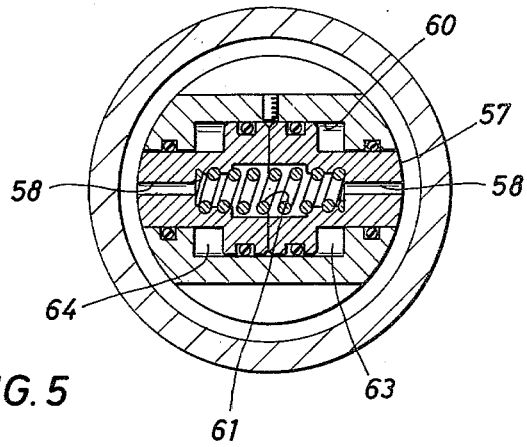
FIG. 5

METHOD AND APPARATUS FOR STIMULATING OIL WELL PRODUCTION

FIELD OF THE INVENTION

This invention relates to methods and apparatus for stimulating oil production and more particularly, to a system operated through a production tubing for the generation of a high intensity back surge of fluid from the formations to clean out damaged oil well perforations.

BACKGROUND OF THE INVENTION

It is a well known problem that use of shaped charged perforators in oil and gas wells produces formation damage by the generation of high energy particulated metal jet of energy which tends to block the pores in the earth's formations. It is also recognized that "back surging" methods which involve creating a high differential pressure across the perforations and subsequent quick release of the pressure differential can induce a release of the damaged surface areas and larger volume flows can be obtained so that the well production is increased.

Prior systems for back surging of perforations in a casing usually have one or more of the following undesirable features:

1. The well may have to be killed, the packer unseated and the production tubing pulled. This means a substantial loss of time and considerable expense as well as possible permanent damage to the well.

2. A safety hazard may exist by running dry production tubing into the well with a rupture type bottom closure in the tubing. This type of back surging system involves a dry production tubing with a frangible bottom closure and it is possible to lose pressure control during the operation.

3. The back surging systems may leave undesirable parts and debris in the bottom of the well which subsequently may affect the production from the well.

The present invention contemplates apparatus and methods to back surge perforated oil and gas wells which have a high differential pressure and high volume flow and will eliminate the above listed undesirable features.

The applicant has a prior U.S. Pat. No. 4,142,583 which is directed to a different type of back pressure apparatus system.

THE PRESENT INVENTION

The present invention includes a plug assembly which is attached to a small diameter tubing which can be concentrically run through the inside of a production tubing into the well under pressure. The plug assembly has a check valve which prevents pressure from entering into the inside of the concentric tubing. For safety purposes, the concentric tubing can be filled with fluid while the plug is being run into the well. When the appropriate depth of the well is reached for operation of the tool the plug assembly is sealed off or packed off with respect to the production tubing so that there is an annulus above the plug assembly which opens to the surface and the cross section of the production tubing is effectively closed off. The pressure in the annulus between the tubing and the production tube is bled off to reduce the pressure within the production tubing. Nitrogen gas pressure or other gas pressure is applied to the interior of the concentric tubing at the surface and will force fluid in the concentric tubing through the check valve and upward through the annulus between the concentric tubing and the production tube and to the well surface. When the fluid column in the tubing annulus is lowered sufficiently to increase the pressure differential across a plug to a pre-determined amount, a pressure sensitive quick opening valve device within the plug automatically opens a by-pass around the sealed plug assembly. Thus, the high volume pressure in the earth formations surges through the perforations and flows through the plug to the reduced pressure within the annulus between the concentric tubing and the production tubing. The check valve prevents entry of pressure into the concentric tubing. After the well has been flowed a desired amount, the well is shut in at the surface and the pressure equalized across the plug. The plug assembly is then removed from the production tubing.

In alternative embodiments, the sealing mechanism can be set by a mechanical means or by seating in a conventional seating nipple. Alternate types of mechanical as well as automatically operated anchor mechanisms may be used. Alternate types of by-pass structural arrangements can be employed.

The advantages of the present invention is that the back surging procedure can be repeated as often as desired by repeating the runs into the well. The back surging can be done at different varying differential pressures by changing the opening pressure requirement of the quick opening valve.

The method is applicable to wells which are new, old or recently perforated. No parts or debris are left in the well and the well is under full control at all times because the production tubing and packer remain undisturbed. The method is also applicable to single completion as well as multiple completion wells.

DESCRIPTION OF THE DRAWINGS

The details of the invention may best be understood in reference to the drawings in which:

FIG. 3 illustrates another form of the present invention in which a tubing seating nipple is provided for the sealing mechanism;

FIG. 4 is an illustration of a hydraulically actuated anchor mechanism;

FIG. 5 is a view and cross-section taken along line 5—5 of FIG. 4; and FIG. 6 is a view of another mechanical variation of the by-pass valve and an anchoring mechanism which involves a seating nipple.

DESCRIPTION OF INVENTION

Figure 1:
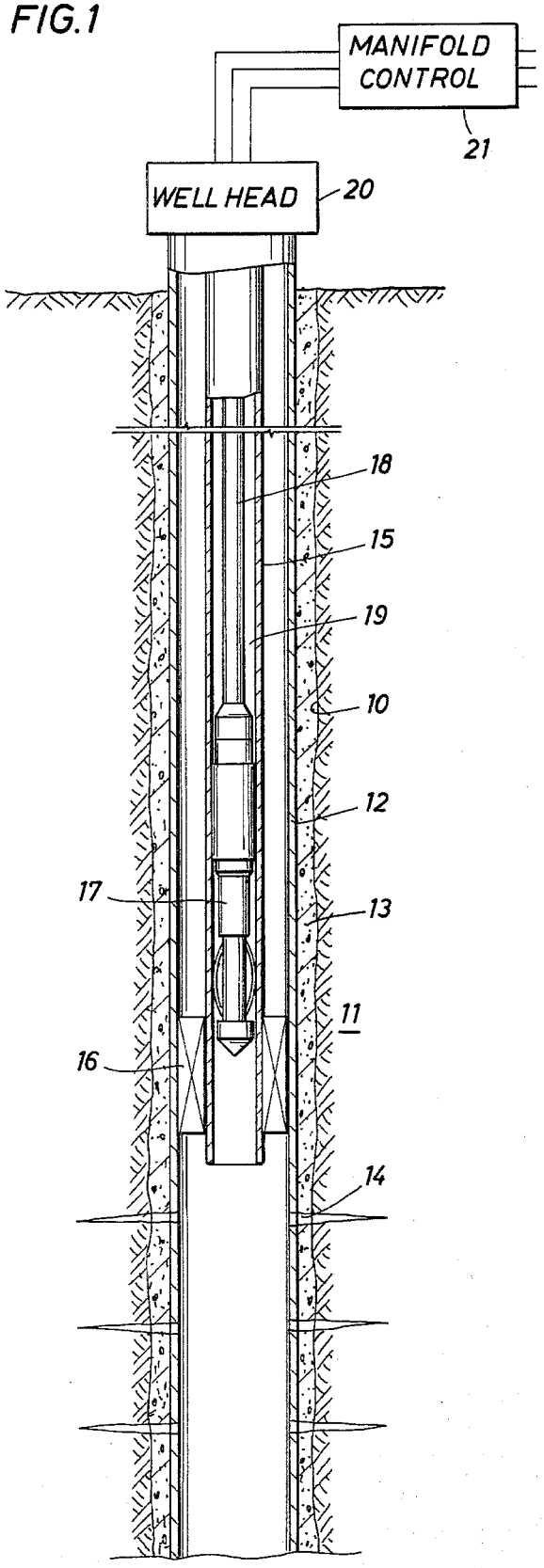
FIG. 1 illustrates an overall schematic relationship of the equipment in a well bore.

FIG. 1 diagrammatically illustrates the overall equipment arrangement for the present invention. In FIG. 1, a well bore 10 traverses earth formations 11. A casing or string of pipe 12 is located within the well bore and cemented in position by a column of cement 13. In the production zone, perforations 14 extend between the casing 12 and the producing earth formations 11. The perforations 14 typically are made in the earth formations by use of shaped charge perforators.

The use of shaped charge perforators involves a generation of a high energy particulated metal jet of energy which produces a conical, elongated perforation. While the shaped charge is an effective means of producing earth perforations, it has some inherent disadvantage in certain formations. Well-bore damage, which is a generalized term, is sometimes incurred with the use of shaped charges. Well bore damage as used herein relates to the blocking of pore spaces in the earth formation by shaped charge perforations and drilling and which cause a reduction of effective permeability.

As illustrated in the diagram of FIG. 1, a small diameter production tubing 15 extends through the casing 12 and has a production packer 16 which seals off the tubing with respect to the casing and thereby permits production of the hydrocarbons through the tubing. In the production of hydrocarbons, the pressure within the porous earth formations 11 is typically greater than the pressure within the production tubing so that the flow of fluids is generally from the formations through the production tubing to the surface of the earth.

It has been found that in certain instances where the well damage is in the perforations 14 that the surfaces defining the perforations can be shocked with a sufficient pressure differential, blocked surfaces are removed and permeability is improved. In other words, by generating a pressure within the formation greatly in excess of the pressure on the other side of the perforation, a sudden release of the pressure can be used to remove damaged surface portion of the perforations.

In accordance with the present invention, a back surge tool 17 is disposed within the production tubing 15 in position above the lower open end of the tubing and is connected through a piping 18 to a surface wellhead 20. At the surface, the piping 18, the producing tubing 15 and the casing 12 are all connected to the well head 20 and also are connected from the well head 20 to a control manifold 21 so that the flow of fluids and pressure within the various pipes can be controlled at the surface of the earth. Thus, there is control of the pressure within the production tubing 15 and control of pressure within the pipe 18 used in the operation.

Figure 2:
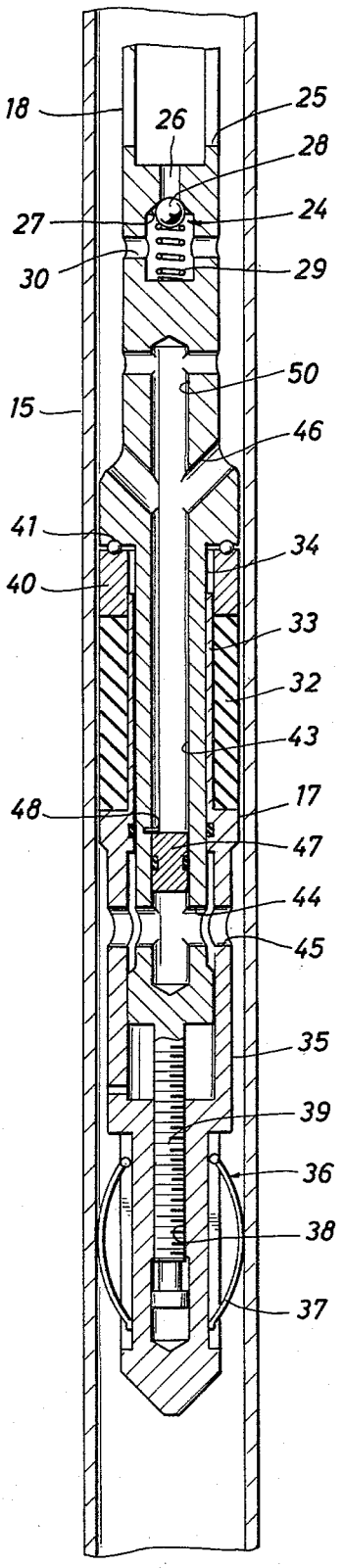
FIG. 2 illustrates one form of the present invention with a mechanically set anchoring mechanism.

Referring now to FIG. 2, one embodiment of the present invention is illustrated in which the back surge tool 17 is shown as coupled to a string of pipe 18. The tool 17 and the pipe 18 are sized for passage through the production tubing 15. The tool 16 is adapted for coupling to the string of tubing as schematically illustrated at 25. In the upper end of the tool 17 is a check valve 24 which consist of a central opening 26 in the tool body and a valve seat 27 on which a ball 28 sits, the ball being normally held in a seated position on the valve seat by means of a spring 29. Ports 30 are provided in the side wall of the tool to open one side of the check valve 24 to the exterior of the tool and the interior of the tubing 15. Thus, fluid under pressure may be passed in one direction from the pipe 18 through the opening 26 above the check valve and through the ports 38 to the tubing 15.

The tool 17 has a packing element 32 which is an annular elastomer element disposed upon a tubular sleeve 33. The sleeve 33 is slidably mounted on a tubular mandrel 34 of the tool 17. The tubular sleeve 33 is attached to a lower tubular housing 35 which, in turn, supports a lower drag spring assembly 36. The drag spring assembly 36 includes three or more circumferential, disposed, resilient drag springs 37, which bend outwardly into frictional contact with the interior of the producting tubing 15. In the interior of the drag spring assembly is a threaded bore section 38 which receives a threaded member 39 attached to the tubular mandrel 34 of the tool. An annular setting sleeve 40 is disposed above the packing element 32 and a thrust bearing 41 is disposed between the setting sleeve 40 and a flange on the tool. Thus, when it is desired to set the packing element 32, the tool is rotated in a clockwise direction. The drag spring assembly 38 will hold the threaded bore section 38 stationary while the threaded section 39 on the tool is rotated to cause the setting sleeve 40 to move downwardly relatively toward the flange on the lower end of the drag spring assembly 36 thereby expanding the packing element 32 into a sealing condition in the production tubing 15.

A fluid by-pass is provided through the tool body across the packing element 32 by means of the tubular passageway 43 in the tool body and ports 44, 45 in the lower end of the tool body and the sleeve member and ports 46 in the upper end of the tool body above the packing element 32. A solid piston member 47 is slidingly and sealingly received within the bore 43 of the tubular mandrel and is held in position by means of a shear pin 48. When the differential pressure across the piston member 47 produces sufficient force relative to the shearing strength of the shear pin 48, the pin 48 is sheared and the piston member 47 is moved upwardly into a ported recess 50 in the tool body thus opening a by-pass passage around the interior of the packing element.

Referring now to FIG. 3, the production tubing 15 can be provided with a conventional seating nipple with a seating shoulder 52 and sealing bore 53. The tool body 17' has an outer sealing member 32 which is sealingly received within the sealing bore 53. The other elements of the tool body which are similar in construction and function and are similarly numbered in FIG. 3. In this embodiment, the weight on the stimulation tubing 18 is used to hold the tool body 17' in a seated position within production tubing 151.

Referring now to FIGS. 4 and 5, still another type of anchoring mechanism is illustrated which can be substituted for the drag spring assembly 36 or can be used on the tool shown in FIG. 3. As illustrated in FIGS. 4 and 5, the tool body 17' is provided with a nose piece 54 which has transverse piston members 55, 56 slidably and sealingly received within a transverse piston cylinders. The piston members 55, 56 have, at their outer ends, a serrated engaging surfaces 57. The piston members 55, 56 are back to back in a piston chamber 60. The interior of the pistons 55, 56 are hollow and a spring 61 is provided which tends to normally pull the piston members 55, 56 toward one another. Bores 58 extend between the interior of the pistons and the exterior of the tool so that the interior of the pistons and the larger cross section of the pistons within cylinder 60 are subject to the pressure existant at the exterior of the tool. The piston members 55, 56 are slidably and sealingly received in the cylinder 60 and have smaller diameter portions within exit bores so as to define pressure chambers 63, 64 within the nose piece 54. The pressure chambers 63, 64 are connected by fluid passageways 65 to the interior 66 of the tool body. The anchor functions as follows:

The pressure in the bore 66 of the tool body is reduced. This reduction in pressure causes the pistons 55, 56 to be urged outwardly into gripping engagement with the wall of the production tubing. When the differential pressure reaches a predetermined value across the piston 47, the force is sufficient to shear the pin 48. When the piston 47 moves upwardly, the fluid under pressure admitted through port 44 is suddenly released so that the formations are subjected to a shock effect. When the pressures differentials across the pistons 55, 56 becomes equalized, the spring 61 (which is under tension) will retract the pistons into the housing to release the anchor on the tool.

Referring now to FIG. 6, a production tubing 54 is provided with a landing nipple having an annular internally located locking groove 70. In this embodiment, the tool body 17' consists of an elongated, tubular mandrel 71 which carries, at its upper end, a housing 72 and locking keys 73 which are normally resiliently biased outwardly and can be positioned in locking engagement with the groove 70. The keys 73 are connected to the tool by pivot pins 74. The locking keys 73, as illustrated, have tab ends 75 which limit their outward pivotal movement and will retract and fit within the overall outer diameter of the tool. The housing has an internal bore 69 which can receive a retrieving tool to retract the keys 73 by engaging the projection portions of the tab ends 75 within the bore 69. Below the locking keys 73 is a standard packing gland 32 for sealing reception within a sealing bore in the landing nipple and below the packing element 32 is the by-pass valve structure 76.

The tool, at its upper end, is connected by an over shot 77 and shear pin 78 member to a concentric tubing 18. The upper end of a tool has an overshot neck configuration 79. At the lower end of the tool body is a bottom tubular nose member 80 which has an interior bore 81 which receives the slidable by-pass valve 82. The slidable by-pass valve 82 has sealing rings which, in the position shown, a closed bore 81. At the upper end of the by-pass valve 82 is a cylindrically shaped flange 83 containing vertical by-pass ports 84. The valve 82 is connected by means of a shear pin 85 to the bottom nose member 80. When the shear pin 85 is sheared, the valve 82 will slide to an upper position within the bore 86 and permit by-pass of fluid through the bore 81 and bypass ports 84.

OPERATION OF THE PRESENT INVENTION

Referring to FIGS. 1 and 2, a tool 17 is run into the well through the production tubing 15 to a location above the perforations 14 to be stimulated. The tool is connected to a concentric tubing 18. The tubing 18 may be filled with fluid, if desired. At the selected location, the tubing 18 is rotated causing the threaded number 39 to traverse the threaded bore 30 and thereby causing the packer element 32 to be expanded into sealing engagement with the inner wall of the production tubing. When the packer is fully expanded, the production tubing is sealed off and the by-pass through the tool is closed by the piston 47. Gas such as nitrogen is pumped through the manifold 21 and wellhead 20 and through the concentric tubing 18. The pressure within tubing 18 is passed from tubing 18 through the check valve 24 and into the annulus 19 between the tubing 18 and the tubing 15. The pressure forces fluid from the annulus 19 out through the wellhead 20 and manifold 21. The removal of fluid from the annulus 19 effectively lowers the pressure within the annulus 19 by reduction of the hydrostatic pressure. While the pressure within the annulus is reduced, the pressure below the tool builds up to the shut-in pressure. The shear pin 48 has a predetermined shearing value and the reduction of pressure above the piston 47 together with the build up of pressure below the piston eventually reach a predetermined pressure differential which produces a force sufficient to shear the pin 48. When the pin 48 is sheared, the piston 47 moves upwardly into a recess bore 50 thereby opening a by-pass by virtue of port 44, 45, bore 43 and ports 46. The opening of the by-pass produces a sudden pressure differential across the perforations 14 which shocks the perforations and relieves the formation blockage in the perforations. The well is always in control at the well head 20. After the stimulation, the tubing 18 is rotated in a counterclockwise direction thereby releasing the packer element 32 and permitting retrieval of the tool. If desired, the stimulation can be repeated by renewing the tool into the well.

Referring now to FIG. 3, the apparatus operates similar to that as described before with respect to FIG. 2. In FIG. 3, the sealing of the cross-section is accomplished by use of a conventional sealing nipple in the production tubing string 15' and a packing 32 on the tool which seals within the bore 53. The tool 15 held in position by applying weight to the concentric tubing 18.

With respect to FIGS. 4 and 5, the apparatus has an anchoring function accomplished by differential pressure where the pressure above the by-pass valve 47 is reduced, the pressure within the chambers 63, 64 of the pistons is reduced. The ported piston members 55, 56 are subject to a higher pressure below the sealing element 32 so that the higher pressure acting on the pistons 55, 56 moves then outwardly to engage the internal wall of the tubing and thus anchors the plug within the tubing 15. While the pistons 55, 56 move outwardly, the spring 61 is placed under increased tension. When the by-pass valve piston 47 is released by shearing of the pin 48, the pressures in the chambers 63, 64 are subsequently increased so that the spring 61 can retract the pistons 55, 56 to their initial position within the plug.

With respect to FIG. 6, the operation is similar to that described before. When the packing 32 enters the sealing bore of the seating nipple, the cross-section of the bore is closed off. The locking dogs 73 engage the locking groove 70 within the sealing nipple so that the plug is sealed and locked in place. Upward movement of the plug is prevented by the locking dogs 73. To release and retrieve the plug, the concentric tubing 18 is pulled so that the shear pin 78 connecting the head 77 and plug is sheared. When the pin 78 is sheared, the tubing 18 and the head 77 are retrieved independently of the plug. Next, a conventional retrieving tool on a slick line (not shown) is run into the tubing to release the dogs 73 from the groove 70 and latch onto the head 79 so that the plug is retrievable.

While only selected embodiments of the present invention are illustrated and described herein, other embodiments of the invention are contemplated and many changes and modifications of the inventions may be made within the scope of the appended claims without departing from the spirit of the invention.

I claim:

1. Apparatus for cleaning perforations in earth formations traversed by a well bore where the well bore contains a well packer and production tubing and where production is from perforations below the packer and through the production tubing to the earth's surface, said apparatus comprising:

an elongated tool body having an upper end adapted for coupling to a string of pipe, said tool body being sized for passage through said production tubing;

packer means on said tool body for movement between a retracted position for passage through said production tubing and an expanded position in sealing engagment with said production tubing;

means in said tool body for passing fluid in only one direction from said upper end in said tool body to the exterior of said tool body at a location above said packer means;

bypass means in said tool body for providing a fluid bypass extending through said packing means and opening to the exterior of said tool body above and below said packing means; and closure means normally closing said bypass means, said closure means being responsive to a selected pressure differential across said packer means for opening said bypass means.

2. The apparatus as defined in claim 1 wherein said means for passing fluid in one direction is a check valve.

3. The apparatus is defined in claim 1 wherein said packing means is an expandable element, and further including means for selectively operating said packing means within said production tubing.

4. The apparatus as defined in claim 1 wherein said closure means includes a closure and shear pin which is operable in response to forces generated by a differential pressure.

5. The apparatus as defined in claim 1 wherein said production tubing includes a sealing bore and said tool includes anchor means attached to the lower end of said tool body, said anchor means including transversely mounted anchoring pistons, said pistons being responsive to differential pressure for moving from a retracted position within the tool body to an extended anchoring position within a production tubing, passage means for placing said piston means in access with pressure above and below said closure means whereby said pistons may be extended in response to a differential pressure across said closure member, and means for retracting said pistons when the pressure across said pistons is equalized.

6. The apparatus is defined in claim 1 wherein said production tubing includes a sealing bore and said tool includes anchor means, said anchor means including locking keys operable to latch said tool in the production tubing, means for selectively releasing said tool from said concentric tubing, said locking keys being responsive to a retrieving tool for release from a latch condition of the tool.

7. A method for cleaning perforations in earth formations traversed by a well bore where the well bore contains a well packer and production tubing and where production is from perforations below the packer and through the production tubing to the earth's surface, the method comprising:

disposing a stimulation tubing within a production tubing;

packing off the stimulation tubing in a selected area of a production tubing at a location above the perforations to be cleaned;

reducing the pressure in the annulus between the stimulation tubing and the production tubing above the selected area packed off in the production tubing; and when the pressure differential across said selected areas reaches a preselected value, opening a bypass across said selected area to place the production tubing below said selected area in fluid communication with the annulus between the stimulation tubing and production tubing above said selected area.

8. The method as defined in claim 7 and further including the step of anchoring the stimulation tubing in the production tubing as a function of the differential pressure across the packed off selected area of the production tubing.

9. Apparatus for creating a pressure surge in a string of tubing disposed in a well bore comprising:

an elongated tool body sized to be passed through a string tubing and adapted at its upper end for connection with a string of pipe;

packer means on said tool body adapted to move between an extended and retracted position, means for moving said packer means between said positions where said extended position permits sealing engagement with said string of tubing and said retracted position permits passage through said string of tubing;

passage means in said tool body for coupling the interior of said string of pipe with the exterior of the tool body at a location above said packer means;

one-way valve means in said passage means for permitting flow of liquid only from said string of pipe to the exterior of said tool body;

bypass passage means in said tool body for defining a fluid passageway between a location above said packer means and a location below said packer means;

plug means disposed in said bypass passage means and in one position normally closing off fluid flow through said bypass passage means and in another position opening said bypass passage means for fluid flow therethrough; and release means for releasably retaining said plug means in said bypass passage, in said one position, said release means being responsive to a predetermined pressure differential for releasing said plug means so that said plug means may be moved to said other position and said bypass passage means may be opened.

* * * * *